US006600120B1

(12) United States Patent
Marmaropoulos et al.

(10) Patent No.: US 6,600,120 B1
(45) Date of Patent: Jul. 29, 2003

(54) MEMBRANE SWITCH ARRANGEMENT WITH CHAMBER VENTING

(75) Inventors: George Marmaropoulos, Yorktown Heights, NY (US); Clive R. Van Heerden, Bronx, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/186,706

(22) Filed: Jul. 1, 2002

(51) Int. Cl.[7] ..... H01H 13/702; H01H 9/02
(52) U.S. Cl. ..... 200/515; 200/5 A; 200/306
(58) Field of Search ..... 200/5 A, 512–517, 200/306; 335/2

(56) References Cited

U.S. PATENT DOCUMENTS 3,383,487 A * 5/1968 Wiener ..... 200/5 A X
4,018,999 A * 4/1977 Robinson et al. ..... 200/5 A
4,046,975 A * 9/1977 Seeger, Jr. ..... 330/81
4,066,851 A * 1/1978 White et al. ..... 200/5 A
4,128,744 A * 12/1978 Seeger ..... 200/5 A
4,194,097 A * 3/1980 Bradam ..... 200/5 A
4,716,262 A * 12/1987 Morse ..... 200/5 A
5,717,429 A * 2/1998 Coulon et al. ..... 345/168
5,780,793 A * 7/1998 Buchholz et al. ..... 200/61.44

* cited by examiner

*Primary Examiner*—J. R. Scott
(74) *Attorney, Agent, or Firm*—Aaron Waxler

(57) ABSTRACT

There is provided a switch having a flexible upper member, that is substantially electrically non-conductive, having an inner surface with an upper contact area that is electrically conductive and connected to a circuit, and a lower member that is substantially electrically non-conductive, having an inner surface with a lower contact area that is electrically conductive and connected to the circuit, wherein the upper member and the lower member are sealingly connected to form a chamber therebetween, the upper contact area and the lower contact area are separated by at least a portion of the chamber and a force applied to the upper member causes the upper contact area and the lower contact area to make contact and close the switch of the circuit.

20 Claims, 3 Drawing Sheets

MEMBRANE SWITCH ARRANGEMENT WITH CHAMBER VENTING

ELECTRICAL SWITCH

1. Field of the Invention

The present invention relates to electrical switches. More particularly, the present invention relates to a flexible, air-cushioned electrical switch.

2. Description of the Prior Art

The use of electrical switches for completing a circuit is known. Such switches include substantially rigid mechanical devices that selectively connect electrically conductive areas to complete the circuit. Also, conductive fibers in various sewn or woven fabrics used as conductive traces, bio-sensors, electrodes, and other wearable electronic devices is known. These wearable electronic devices typically require switches to operate. A drawback of contemporary switches is the rigidity of the device that is connected to the flexible wearable electronic device. This rigidity limits comfort for the wearer of the wearable electronic device and further increases the likelihood of damage to the device as a result of being worn. Thus, there is a need for a flexible electric switch without the above noted drawbacks. The preferred embodiments of the present invention fulfill this need.

SUMMARY OF THE INVENTION

It is an object of the present invention to provide an improved electrical switch.

It is another object of the present invention to provide such a switch with flexibility.

It is yet another object of the present invention to provide such a switch adapted for use with various wearable electronic devices and/or sensors.

It is a further object of the present invention to provide such a switch that enhances comfort.

It is still a further object of the present invention to provide such a switch that reduces the likelihood of damage.

These and other objects and advantages of the present invention are achieved by a switch comprising a flexible upper member, that is substantially electrically non-conductive, having an inner surface with an upper contact area that is electrically conductive and connected to a circuit, and a lower member that is substantially electrically non-conductive, having an inner surface with a lower contact area that is electrically conductive and connected to a circuit. The upper member and the lower member are sealingly connected to form a chamber therebetween, the upper contact area and the lower contact area are separated by at least a portion of the chamber and a force applied to the upper member causes the upper contact area and the lower contact area to make contact and close the switch of the circuit. The chamber of the switch can contain a fluid to separate the upper member and the lower member and the fluid can be air. Preferably, the lower member is flexible and the upper member has a dome-like shape. The upper contact area and the lower contact area can be aligned across the chamber. Preferably, the upper contact area is generally centrally located along the inner surface of the upper member and the lower contact area is generally centrally located along the inner surface of the lower member. The upper contact area can be partially embedded in the inner surface of the upper member and the lower contact area can be partially embedded in the inner surface of the lower member. The upper member and the lower member can be integrally formed. The upper contact area can be a plurality of upper contact areas, the lower contact area can be a plurality of lower contact areas and each of the plurality of upper contact areas can be aligned with one of the plurality of lower contact areas.

The present invention can also be an array of electrical switches comprising a flexible upper member that is substantially electrically non-conductive, separated into two or more portions, that each have an inner surface with an upper contact area that is electrically conductive and connected to a circuit and a lower member that is substantially electrically non-conductive, having an inner surface with a corresponding lower contact area for each of the upper contact areas, and is electrically conductive and connected to the circuit. Each of the two or more portions and the lower member are sealingly connected to form chambers therebetween. Each of the chambers is in fluid communication with at least one of the other of the chambers and each of the chambers contains a fluid that separates the two or more portions from the lower member. The upper contact areas and the lower contact areas are separated by at least a portion of the chambers and a force applied to one of the chambers causes the fluid to flow from the one of the chambers to at least one of the other of the chambers allowing the upper contact area of the one of the chambers and the corresponding lower contact area to make contact and close the switch of the circuit. Each of the chambers can be in fluid communication with at least one of the other of the chambers by a channel. Preferably, the fluid is air. More preferably, the lower member is flexible. Each of the two or more portions can have a dome-like shape. Preferably, the upper contact areas and the corresponding lower contact areas are aligned across the chambers. More preferably, the upper contact areas are centrally located along the inner surface of the two or more portions and the corresponding lower contact areas are centrally located along the inner surface of the lower member. Each of the upper contact areas can be partially embedded in the inner surface of the two or more portions and the lower contact areas can be partially embedded in the inner surface of the lower member. The two or more portions and the lower member can be integrally formed.

BRIEF DESCRIPTION OF THE DRAWINGS

The present invention is more fully understood by reference to the following detailed description of a preferred embodiment in combination with the drawings identified below.

DETAILED DESCRIPTION OF THE INVENTION

Figure 1:
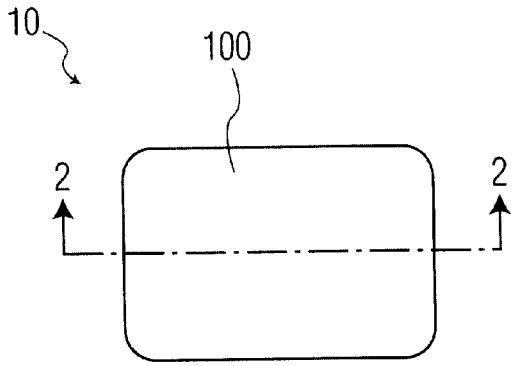
FIG. 1 is a top plan view of a switch in accordance with the present invention.

Referring to the drawings and, in particular, FIG. 1, there is shown an improved switch in accordance with the present invention generally represented by reference numeral 10. Switch 10 is a single switch having a substantially rectangular shape. However, alternative shapes for switch 10 can also be used including circular or square.

Figure 2:
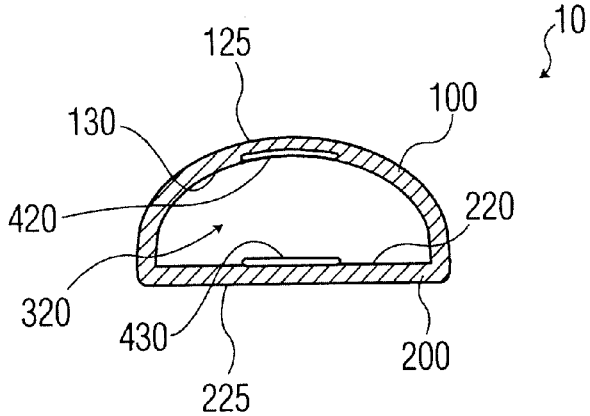
FIG. 2 is a cross-sectional plan view of the switch taken along line 2—2 of FIG. 1.

Referring to FIGS. 1 and 2, switch 10 has an upper layer 100 and a lower layer 200. Upper and lower layers 100, 200 are made of a soft, flexible material such as silicone. The flexibility of layers 100, 200 protect against damage when switch 10 is used with wearable electronics. Moreover, the flexibility of layers 100, 200 provide comfort to the wearer when switch 10 is used with wearable electronics. Preferably, upper and lower layers 100, 200 are made of a material that is air-tight. More preferably, upper and lower layers 100, 200 are made of a material with elasticity. Upper and lower layers 100, 200 are substantially electrically non-conductive. Preferably, upper layer 100 has a convex, dome-like shape. Upper layer 100 has an outer surface 125 for providing comfort to the wearer when switch 10 is used with wearable electronics and an inner surface 130. Lower layer 200 has an inner surface 220 and an outer surface 225 for providing comfort to the wearer when switch 10 is used with wearable electronics.

Referring to FIG. 2, upper layer 100 is sealingly connected to lower layer 200. Alternatively, upper layer 100 and lower layer 200 can be integrally formed. Additionally, while this embodiment has two layers 100, 200 that are sealingly connected, switch 10 can have more than two layers that are sealingly connected. In this embodiment, upper layer 100 and lower layer 200 are sealingly connected directly to each other, however alternative embodiments can include an indirect sealing engagement such as a material disposed between the layers.

The sealing connection of upper layer 100 with lower layer 200 forms first chamber 320. In this embodiment, chamber 320 is filled with air. The air separates upper and lower layers 100, 200 when switch 10 is not being depressed. Alternatively, other non-conductive fluids or combinations of fluids may fill chamber 320. Chamber 320 has an upper contact 420 connected to upper layer 100 and a lower contact 430 connected to lower layer 200. Upper contact 420 and lower contact 430 are areas of electrical conductivity which, when in contact with each other, allow the flow of electricity therethrough. Upper contact 420 and lower contact 430 are each connected to, and part of, a circuit (not shown) which requires selective opening and closing of the switch, i.e., the contact areas. Outer surface 225 of lower layer 200 can be secured to wearable electronics by various means including adhesive and being sewn.

Preferably, upper contact 420 is centrally located along upper layer 100 and adjacent to inner surface 130. Similarly, lower contact 430 is preferably centrally located along lower layer 200 and adjacent to inner surface 220. Preferably, upper contact 420 and lower contact 430 are aligned on opposing sides of chamber 320. Upper and lower contacts 420, 430 can be secured to upper and lower layers 100, 200 by various means including adhesive or partially embedding the contacts in the layers so as to leave an area exposed for flow of electricity therethrough.

Figure 3:
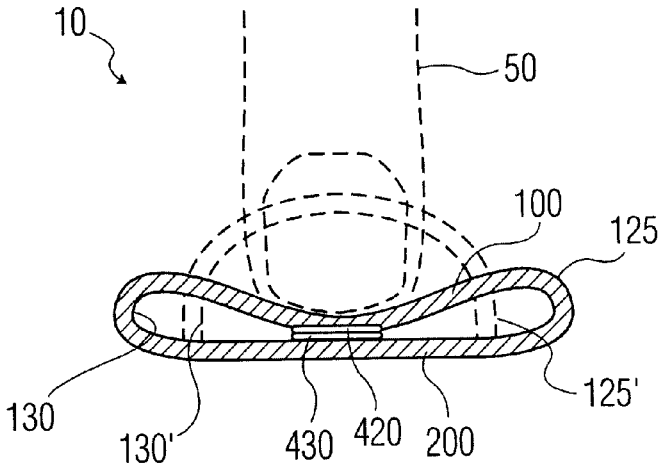
FIG. 3 is a cross-sectional plan view of the switch being depressed, taken along line 2—2 of FIG. 1.

Referring to FIG. 3, switch 10 is shown after being depressed by finger 50. The depression of upper layer 100 causes upper contact 420 to be brought into contact with lower contact 430. The contact of upper contact 420 and lower contact 430 closes switch 10. The flexibility of upper layer 100 allows the air that was disposed generally in the space or volume between upper and lower contacts 420, 430 to move radially outward, outside of that space. Outer and inner surfaces 125, 130 of upper layer 100 are stretched outwardly as a result of the displaced air from the space between upper and lower contacts 420, 430. Broken lines 125', 130' show outer and inner surfaces 125, 130 when not being outwardly stretched as a result of the displaced air from the space between upper and lower contacts 420, 430.

Figure 4:
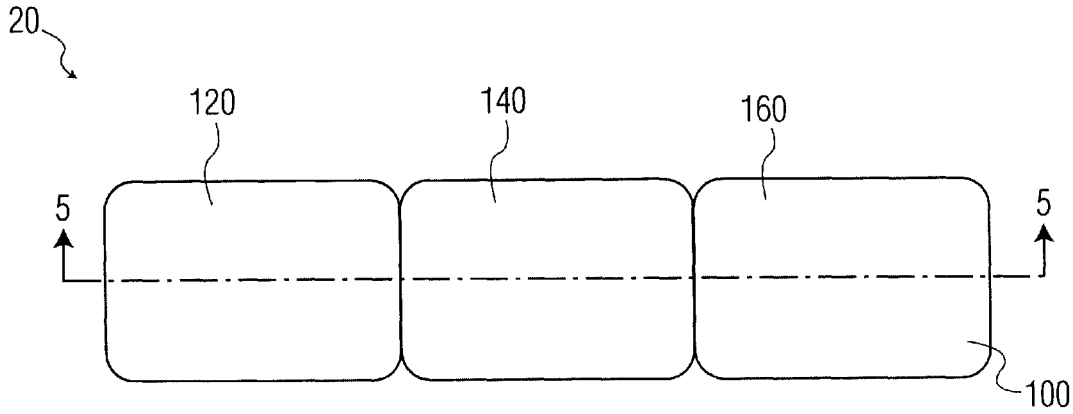
FIG. 4 is a top plan view of an alternative embodiment of a switch in accordance with the present invention.

Referring to FIG. 4, there is shown an improved switch in accordance with an alternative embodiment of the present invention, generally represented by reference numeral 20. Switch 20 is an array of switches, as will be discussed later in detail, that have a substantially rectangular shape. However, alternative shapes for switch 20 can also be used including circular or square. Features common to both the embodiments of switch 10 and switch 20 are denoted with the same reference numbers.

Figure 5:
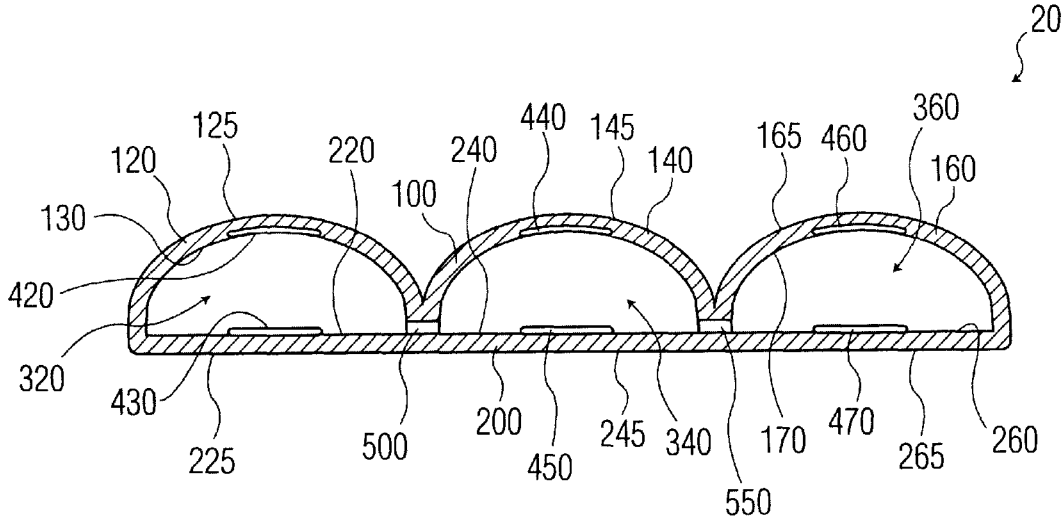
FIG. 5 is a cross-sectional plan view of the switch taken along line 5—5 of FIG. 4.

Referring to FIGS. 4 and 5, switch 20 has an upper layer 100 and a lower layer 200. Upper and lower layers 100, 200 are made of a soft, flexible material such as silicone. Additionally, upper and lower layers 100, 200 are impermeable or air-tight and are substantially electrically non-conductive. Preferably, upper and lower layers 100, 200 are made of a material with elasticity. Preferably, upper layer 100 has convex, dome-like portions 120, 140, 160. Portions 120, 140, 160 have outer surfaces 125, 145, 165 and inner surfaces 130, 150, 170, respectively. In this embodiment, three portions 120, 140, 160 are shown. The number of portions preferably corresponds to the number of switches contained in switch 20. The dome-like shape of portions 120, 140, 160 assists a user in distinguishing between the different switches of the array. However, alternative shapes for portions 120, 140, 160 can also be used including flat or concave shapes. Also, while this embodiment provides for a plurality of portions each with a switch disposed therein, alternatively, switch 20 can have a single portion having a plurality of switches disposed therein, or any combination of portions and switches.

Referring to FIG. 5, portions 120,140,160 of upper layer 100 are sealingly connected to lower layer 200. Alternatively, upper and lower layers 100, 200 can be integrally formed. Additionally, while this embodiment has two layers 100, 200 that are sealingly connected, switch 20 can have more than two layers that are sealingly connected and can have an indirect sealing connection of layers 100, 200.

The sealing connection of portions 120, 140,160 of upper layer 100 with lower layer 200 forms first chamber 320, second chamber 340 and third chamber 360. In this embodiment, chambers 320, 340, 360 are filled with air. The air separates upper and lower layers 100, 200 when switch 20 is not being depressed. Alternatively, other non-conductive fluids or combination of fluids may be placed in chambers 320, 340, 360. The embodiment shown has three chambers 320, 340, 360 that form a linear array of three switches. However, any number of switches and any number of chambers can be used including a single chamber having a plurality of switches, i.e., electrical contact areas. While switch 20 shows a linear array of switches, chambers 320, 340, 360 can be positioned in any configuration. Thus, as described above, switch 20 is not limited to any particular shape but, by way of example, is shown in a rectangular shape. Lower layer 200 of chambers 320, 340, 360 have inner surfaces 220, 240, 260 and outer layers 225, 245, 265, respectively.

Chambers 320, 340, 360 have upper contacts 420, 440, 460 connected to upper layer 100 and lower contacts 430, 450, 470 connected to lower layer 200. Upper contacts 420, 440, 460 and lower contacts 430, 450, 470 are areas of electrical conductivity which, when in contact, allow the flow of electricity therethrough. Upper contacts 420, 440, 460 and lower contacts 430, 450, 470 are each connected to, and part of, a circuit (not shown) which requires selective opening and closing of the respective switches, i.e., contact areas.

Preferably, upper contacts 420, 440, 460 are centrally located along inner surfaces 130, 150, 170, respectively. Similarly, lower contacts 430, 450, 470 are preferably centrally located along inner surfaces 220, 240, 260, respectively. Preferably, upper contacts 420, 440, 460 and lower contacts 430, 450, 470 are aligned on opposing sides of chambers 320, 340, 360, respectively. Upper contacts 420, 440, 460 and lower contacts 430, 450, 470 can be secured to layers 100, 200 by various means including adhesive or partially embedding the contacts in the layers so as to leave an area exposed for flow of electricity therethrough.

Switch 20 further comprises channels 500, 550. Channel 500 is formed in upper layer 100 and provides for fluid communication between chamber 320 and chamber 340. Preferably, channel 500 is formed adjacent to lower layer 200. More preferably, channel 500 is centrally located adjacent to lower layer 200 between chamber 320 and chamber 340. Channel 550 is formed in upper layer 100 and provides for fluid communication between chamber 340 and chamber 360. Preferably, channel 550 is formed adjacent to lower layer 200. More preferably, channel 550 is centrally located adjacent to lower layer 200 between chamber 340 and chamber 360. In this embodiment, individual channels 500, 550 provide fluid communication between chambers 320, 340 and chambers 340, 360, respectively. Alternatively, a plurality of channels can be formed between chambers 320, 340 and chambers 340, 360 for fluid communication therebetween. Also, while fluid communication between portions 120, 140, 160 is provided by channels 500, 550 in this embodiment, the switches can have alternative means for fluid communication such as a single portion with a plurality of switches disposed therein. Additionally, while channels 500, 550 are centrally located adjacent to lower layer 200, the channels can also be located remote from the lower layer and do not require placement in a central position.

Figure 6:
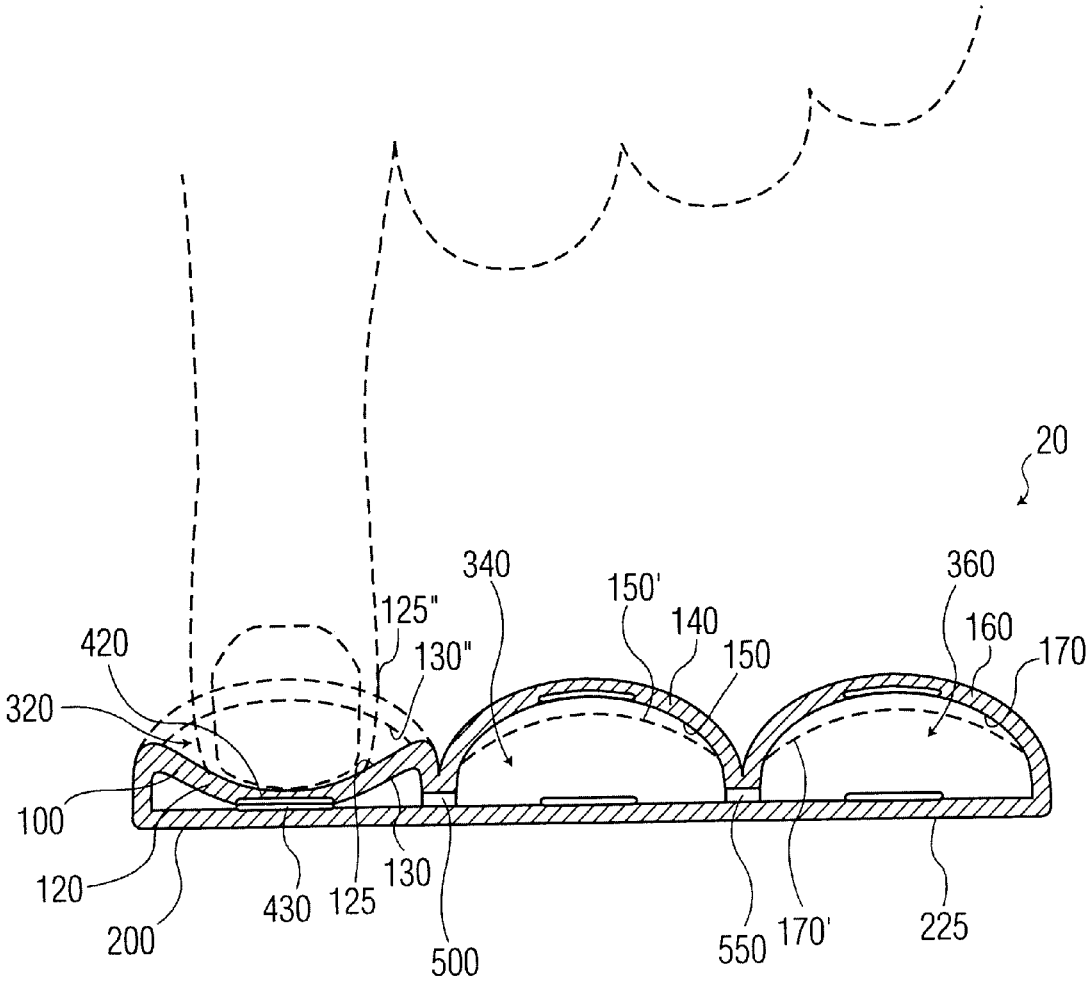
FIG. 6 is a cross-sectional plan view of the switch being depressed, taken along line 5—5 of FIG. 4.

Referring to FIG. 6, switch 20 is shown after being depressed by finger 50. The depression of upper layer 100 causes upper contact 420 to be brought into contact with lower contact 430. The contact of upper contact 420 and lower contact 430 closes switch 20. The air that was disposed within first chamber 320 generally in the space between upper contact 420 and lower contact 430 moves through channels 500, 550 into second chamber 340 and third chamber 360. The displaced air that moves into second chamber 340 and third chamber 360 causes the chambers to expand. Upper layer 100 of portions 140, 160 is stretched upwardly as a result of the displaced air from first chamber 320. Broken lines 150', 170' show inner surfaces 150, 170 of upper layer 100 when not being upwardly stretched as a result of the displaced air from first chamber 320. Due to the air-tight seal and the elasticity of upper layer 100, after finger 50 is released from portion 120, the displaced air flows back into first chamber 320, and outer and inner surfaces 125, 130 return to their unbiased positions represented by broken lines 125", 130", respectively. This causes upper contact 420 and lower contact 430 to separate and switch 20 is opened.

The present invention having been thus described with particular reference to the preferred forms thereof, it will be obvious that various changes and modifications may be made therein without departing from the spirit and scope of the present invention as defined in the appended claims.

What is claimed is:

1. An electrical switch comprising:

a flexible upper member that is substantially electrically non-conductive, said upper member having an outer surface and an inner surface with an upper contact area that is electrically conductive and connected to a circuit; and a lower member that is substantially electrically non-conductive, said lower member having an outer surface and an inner surface with a lower contact area that is electrically conductive and connected to said circuit, wherein said upper member and said lower member are sealingly connected to form an impermeable chamber therebetween, said upper contact area and said lower contact area are separated by at least a portion of said chamber and a force applied to said upper member causes at least said upper member to stretch outwardly in a lateral direction such that said upper contact area and said lower contact area can make contact and close said circuit.

2. The switch of claim 1, wherein said chamber contains a fluid to separate said upper member and said lower member.

3. The switch of claim 2, wherein said fluid is air.

4. The switch of claim 1, wherein said lower member is flexible.

5. The switch of claim 2, wherein said upper member has a dome-like shape.

6. The switch of claim 2, wherein said upper contact area and said lower contact area are aligned across said chamber.

7. The switch of claim 6, wherein said upper contact area is centrally located along said inner surface of said upper member and said lower contact area is centrally located along said inner surface of said lower member.

8. The switch of claim 2, wherein said upper contact area is partially embedded in said inner surface of said upper member and said lower contact area is partially embedded in said inner surface of said lower member.

9. The switch of claim 2, wherein said upper member and said lower member are integrally formed and said outer surfaces thereof provide comfort to a wearer when the switch is used with wearable electronics.

10. The switch of claim 1, wherein said upper contact area is a plurality of upper contact areas, said lower contact area is a plurality of lower contact areas and each of said plurality of upper contact areas is aligned with one of said plurality of lower contact areas.

11. An array of electrical switches comprising:

a flexible upper member that is substantially electrically non-conductive, said upper member separated into two or more portions, each of said two or more portions having an inner surface with an upper contact area that is electrically conductive and connected to a circuit; and a lower member that is substantially electrically non-conductive, said lower member having an inner surface with a corresponding lower contact area for each of said upper contact areas, said lower contact areas being electrically conductive and connected to said circuit, wherein each of said two or more portions and said lower member are sealingly connected to form air tight chambers therebetween, each of said chambers is in fluid communication with at least one of the other of said chambers, each of said chambers contains a fluid that separates said two or more portions from said lower member, said upper contact areas and said lower contact areas are separated by at least a portion of said chambers and a force applied to one of said chambers causes said fluid to flow from said one of said chambers to at least one of the other of said chambers causing said at least one of the other of said chambers to expand and allowing said upper contact area of said one of said chambers and said corresponding lower contact area to make contact and close the switch of said circuit.

12. The switch of claim 11, wherein each of said chambers is in fluid communication with at least one of the other of said chambers by a channel.

13. The switch of claim 11, wherein said fluid is air.

14. The switch of claim 11, wherein said lower member is flexible.

15. The switch of claim 12, wherein each of said two or more portions have a dome-like shape.

16. The switch of claim 12, wherein each of said upper contact areas are aligned across said chambers with said corresponding lower contact areas.

17. The switch of claim 16, wherein said upper contact areas are centrally located along said inner surface of said two or more portions and said corresponding lower contact areas are centrally located along said inner surface of said lower member.

18. The switch of claim 12, wherein each of said upper contact areas are partially embedded in said inner surface of said two or more portions and said lower contact areas are partially embedded in said inner surface of said lower member.

19. The switch of claim 12, wherein said two or more portions and said lower member are integrally formed.

20. An electrical switch for use with wearable electronics, comprising:

a flexible upper member, said upper member having an outer surface suitable for providing comfort to a wearer when the switch is used with wearable electronics and an inner surface with an upper contact area that is electrically conductive and connected to a circuit; and a lower member, said lower member having an outer surface suitable for providing comfort to a wearer when the switch is used with wearable electronics and an inner surface with a lower contact area that is electrically conductive and connected to said circuit, wherein said upper member and said lower member are sealingly connected to form an impermeable chamber therebetween, said upper contact area and said lower contact area are separated by at least a portion of said chamber such that a force applied to said upper member causes at least said upper member to stretch outwardly in a lateral direction allowing said upper contact area and said lower contact area to make contact and close said circuit.

* * * * *